United States Patent [19]

Stern

[11] 4,360,118

[45] Nov. 23, 1982

[54] SELF-MATING PIZZA PIE CONTAINER

[76] Inventor: James J. Stern, 115 Old Short Hills Rd., Apt. 343, Bldg. 32, West Orange, N.J. 07052

[21] Appl. No.: 207,374

[22] Filed: Nov. 17, 1980

[51] Int. Cl.[3] ..... A45C 11/20; B65D 1/24

[52] U.S. Cl. ..... 220/4 E; 206/545; 220/306

[58] Field of Search ..... 220/4 B, 4 E, 72, 902, 220/306; 206/545

[56] References Cited

U.S. PATENT DOCUMENTS

| | | | |
|---|---|---|---|
| 2,787,397 | 4/1957 | Radford | 220/72 |
| 3,417,894 | 12/1968 | Gittler | 220/4 E |
| 3,448,850 | 6/1969 | Segel | 220/4 E |
| 3,484,015 | 12/1969 | Rowan | 220/4 E |
| 3,516,573 | 6/1970 | Mizuk | 220/72 |
| 3,664,538 | 5/1972 | Fioretti | 220/4 E |
| 3,845,875 | 11/1974 | Douglas | 220/902 |
| 4,058,214 | 11/1977 | Mancuso | 206/545 |
| 4,195,746 | 4/1980 | Cottrell | 220/4 E |

*Primary Examiner*—George E. Lowrance

*Attorney, Agent, or Firm*—Ernest H. Schmidt

[57] ABSTRACT

A pair of circular, shallow, container lower and upper half-sections, integrally molded of a light-weight, thermally insulating material, are formed along their peripheral side-walls with mutually interfitting and interlocking means which is readily releasable for uncovering a contained pizza pie. Each half-section has, in its peripheral rim, diagonally opposed locating pin and locating recess means for the interfitting reception of the complemental locating pin and recess of the companion half-section for relative rotational locating of the two half-sections, and resilient hook means adapted to interhookingly engage under rim edge portions of the companion half-section upon the half-sections being so relatively located and interfitted.

5 Claims, 5 Drawing Figures

SELF-MATING PIZZA PIE CONTAINER

BACKGROUND OF THE INVENTION

This invention relates to food containers or carriers, and is directed particularly to a disposable container for use in packaging for delivery or transport of a freshly made, hot pizza pie, or the like, to the purchaser or consumer.

The use of shallow cardboard containers or boxes for the packaging of hot pizza pies and the like is commonplace. Such containers as have heretofore been devised for this purpose, however, are deficient in various respects, principally in that, if inexpensive enough to be disposable, they do not provide sufficient thermal insulation to prevent substantial dissipation of the heat of a freshly baked pizza pie during transport from the bakery to the consumer. This, of course, is especially true during cold weather, and when the packaged pizza pie is to be carried over a longer distance. When the pizza pie cools it loses some of its flavor and crispiness and therefore does not provide the maximum eating enjoyment sought by most people in a freshly baked pizza.

BRIEF SUMMARY OF THE INVENTION

It is, accordingly, the principal object of this invention to provide a novel and improved self-mating pizza pie container that obviates the deficiencies of disposable carrying containers heretofore devised.

A more particular object is to provide a pizza pie container that is integrally molded of identical, self-mating lower and upper half-sections for economy of manufacture and simplicity in opening and closing, and which may readily be fabricated of a foamed, synthetic plastic material such as polyurathane for its high heat insulation qualities.

Another object of the invention is to provide a self-mating pizza pie container of the character described wherein there is substantial over-lap at the mating peripheral edge portions of the lower and upper half-sections when enclosing a pizza pie, so as to virtually eliminate heat loss due to leakage at this juncture.

Another object is to provide a self-mating pizza pie container of the above nature which is formed, in its lower and upper surfaces, with a plurality of radially-extending reinforcing ribs which, in the lower or bottom half-section, serve additionally as spacers elevating the bottom half-section from any flat surface upon which the container may be placed and thereby minimize the possibility of conductive heat dissipation to such surfaces.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figure 1:
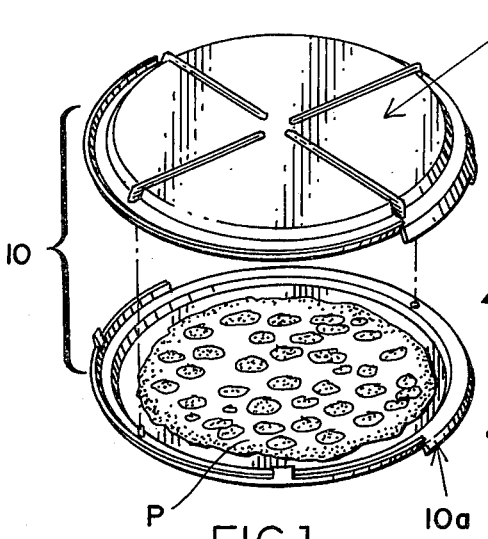
FIG. 1 is an oblique view of a self-mating pizza pie container embodying the invention, showing the bottom and top half-sections in relatively separated condition and with a pizza pie in place for carrying in the bottom half-section.

Referring now in detail to the drawings, reference numeral 10 in FIGS. 1, 2, 4, 5 designates, generally, a self-mating pizza pie container embodying the invention, the same being shown in open or separated condition in FIG. 1, with a pizza pie in place. The pizza pie container 10, which will preferably be integrally formed of a light-weight, inexpensive material having a low coefficient of thermal conductivity such as foamed polyurathane, is comprised of a pair of self-mating bottom and top half-sections **10*a* and 10*b*, identical in structure. Since the two bottom and top half-sections are identical and are self-mating as is hereinafter more particularly described, only the bottom half-section 10*a*** is described in detail herein.

Figure 2:
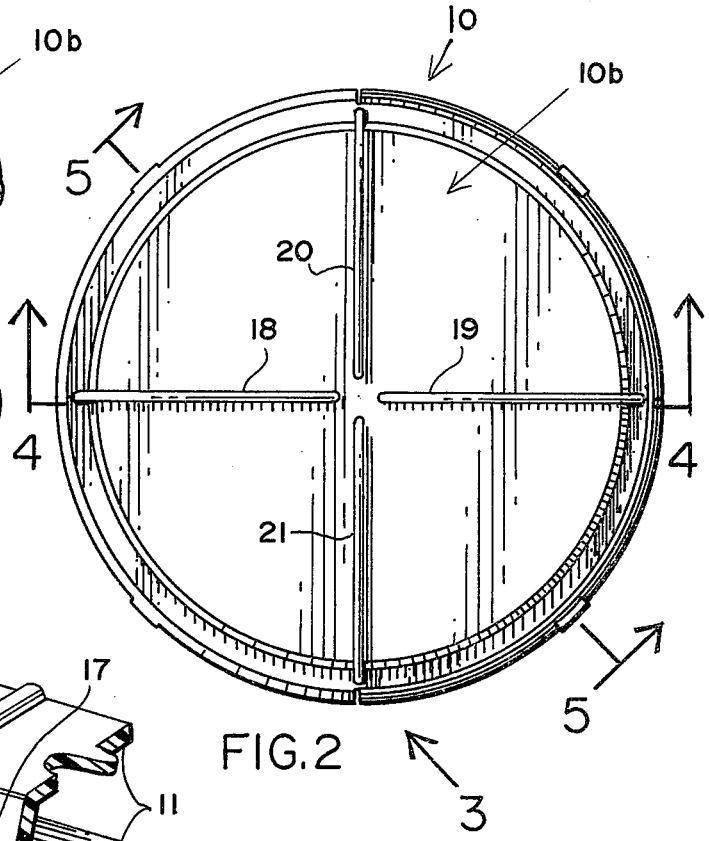
FIG. 2 is a top view of the pizza pie container, shown closed and on an enlarged scale.
Figure 3:
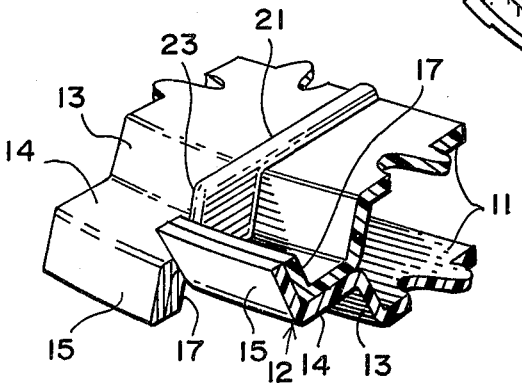
FIG. 3 is a partial, oblique view of the pizza pie container illustrating, on an enlarged scale, details of the interfitting connection of the two bottom and top half-sections.
Figure 4:
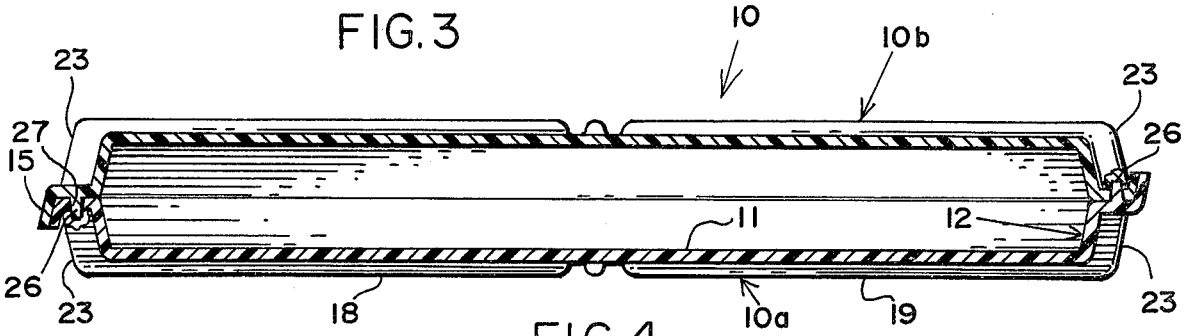
FIG. 4 is a transverse, cross-sectional view taken along the plane indicated at 4—4 of FIG. 2 in the direction of the arrows.

As best illustrated in FIGS. 1, 3, 4 and 5, the bottom half-section **10*a* comprises a flat, circular body portion 11 having a relatively short, upwardly-extending, peripheral rim indicated, generally, at 12. The rim 12 is integrally formed with an upwardly and slightly outwardly-inclined side-wall portion 13 merging at its upper end with an equally short, outwardly-extending peripheral flange portion 14 lying in a plane in spaced, parallel relation with respect to the plane of circular bottom portion 11. The rim flange portion 14, to an extent of slightly less than 180 circular degrees about its periphery, merges with an upwardly and slightly outwardly-inclined first terminal rim portion 15. The remaining approximately 180 circular degree peripheral extent of the rim flange portion 15 merges with a relatively short, downwardly and slightly outwardly-inclined second terminal rim portion 17. For strengthening purposes and for slightly elevating the bottom half-section 10*a* from a flat surface upon which the pizza pie container may be seated, the underside of the circular body portion 11 thereof is integrally formed with four radially-extending ribs 18, 19, 20 and 21, 90 circular degrees separated from one another (see also FIG. 2). As best illustrated in FIG. 4, the outer ends of the ribs 18 through 21 extend downwardly at their outer ends to merge with adjacent portions of outwardly-extending peripheral flange portion 14, as is indicated at 23**.

Figure 5:
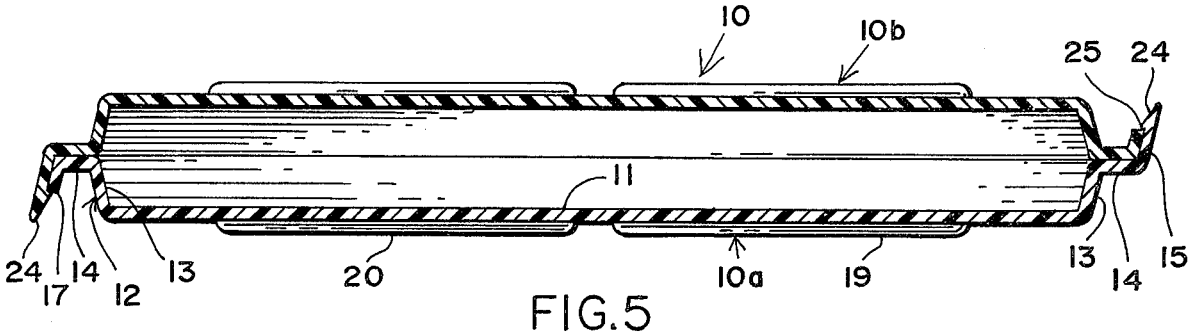
FIG. 5 is a transverse cross-sectional view taken along the plane indicated at 5—5 of FIG. 2 in the direction of the arrows.

As best illustrated in FIGS. 1, 2 and 5, the outer end of first terminal rim portion 15, at symmetrically-spaced positions therealong, extends into a pair of upwardly and outwardly-extending hook portions 24 defining a short, inwardly-extending shoulder 25. As best illustrated in FIGS. 1 and 3, the horizontal, outwardly-extending, peripheral flange portion 14 is provided with a frustoconical, upwardly-extending, locating pin 26, at a position therealong that is adjacent to and central along the extent of first terminal rim portion 15. As best illustrated in FIG. 1, the outwardly-extending peripheral flange portion 14 is also formed with a round recess 27, diametrically opposed to locating pin 26, for the reception of a mating locating pin of the top half-section **10*b*, as is hereinafter more particularly described. As illustrated in FIG. 4, the radial rib 18 is so located that its downwardly-extending outer end 23 is in register with the recess 27**, so that the bottom of said recess extends thereinto.

As best illustrated in FIG. 3, the first and second terminal rim portions 15 and 17 are of such size and configuration that when mating bottom and top sections of the pizza tray are interfitted with the locating pin 26 of one section being received in the recess 27 of the other section, they will be in close-fitting, nesting relation, with their outer ends lying in a common plane. When so interfitted and pressed together in the relative angular positions illustrated in FIG. 1, the two hook portions 24 of one half-section will be bent slightly outwardly to resiliently snap into hooking engagement with edge portions of second terminal rim portion 17 of the mating tray half-section, to retain the two bottom and top half-sections 10*a* and 10*b* in interconnected relation for supporting and carrying a pizza pie. To separate the top half-section from the bottom half-section, it is only necessary to manually bend the two upwardly-extending hook portions 24 outward slightly to disengage from the adjacent second terminal rim portion 17 of the mating top half-section, whereupon the top half-section can readily be separated and removed for serving the pizza pie from the tray-like bottom half-section of the container.

While I have illustrated and described herein only one form of self-mating pizza pie container comprising the invention, it is to be understood that this embodiment is presented by way of example only and not in a limiting sense. For example, although the pizza pie container is described as being disposable, it is of such rigid construction as permits reuse for a substantial number of times, especially if the outer surfaces of the half-sections were coated or sprayed with a protective coating of a suitable synthetic plastic material. The invention, in brief, comprises all the embodiments and modifications coming within the scope and spirit of the following claims:

What I claim as new and desire to secure by Letters Patent is:

1. A self-mating pizza pie container comprising, in combination, a pair of identical, circular, lower and upper container half-sections, each having a flat circular body portion and a relatively short rim member defining, together with its body portion, a shallow recess, said rim member, at the inside thereof, defining an obtuse angle with respect to the inside of said circular body portion, the insides of said body portion and said rim having smooth surfaces, each container half-section having, in its peripheral rim member, opposed locating pin and locating recess means for the interfitting reception of the complemental locating pin and locating recess means of the companion half-section for relative rotational locating for closure of said two half-sections, each container half-section further having in its peripheral rim member resilient means adapted to interhookingly engage under rim member edge portions of the companion container half-section upon said half-sections being so relatively located and interfitted for closure, said interhookingly engaging means comprising a first, upwardly-extending, terminal rim portion integrally formed with each of said rim members, and a second downwardly-inclined terminal rim portion integrally formed with each of said rim members, said first terminal rim portions being of such configuration as to overlap in close-fitting nesting relation upon said lower and upper container half-sections being so interfitted for closure, said second terminal rim portions each further comprising a plurality outwardly-extending hook portions defining resilient, inwardly-extending shoulders adapted to interhookingly engage edge portions of the second terminal rim portion of the companion container half-sections upon a pair of said container sections being so interfitted for closure, said first terminal rim portion extending approximately 180 circular degree about its circular body portion, and said second terminal rim portion extending approximately the remaining 180 circular degrees about its circular body portion.

2. A self-mating pizza pie container as defined in claim 1, wherein said opposed locating pin and locating recess means comprises a locating pin and a complemental locating recess diametrically-opposed to one another in each rim member of each container half-section, the longitudinal axes of which locating pin and recess are perpendicular with respect to the plane of their associated circular body portion, said locating pins extending outwardly of the recesses of their respective container half-sections.

3. A self-mating pizza pie container as defined in claim 1, wherein said container half-sections are integrally fabricated of a synthetic plastic material having a low coefficient of thermal conductivity.

4. A self-mating pizza pie container as defined in claim 1, wherein said container half-sections are integrally formed of a foamed synthetic plastic material.

5. A self-mating pizza pie container as defined in claim 4, wherein the undersides of said container half-sections are integrally formed with a plurality of radially-extending ribs.

* * * * *